106-99 AU 115 EX
3/2/76 XR 3,941,918

United States Patent [19]

Nigol et al.

[11] 3,941,918

[45] Mar. 2, 1976

[54] ELECTRICAL INSULATOR INCLUDING AN INSULATION SHELL HAVING HARDWARE MEMBERS SECURED THERETO BY CEMENT CONTAINING GRAPHITE FIBERS

[75] Inventors: Olaf Nigol, Etobicoke; Gordon Rosenblatt, Burlington, both of Canada

[73] Assignee: Canadian Porcelain Company Limited, Hamilton, Canada

[22] Filed: Jan. 22, 1973

[21] Appl. No.: 325,331

[52] U.S. Cl. ..... 174/140 C; 106/99; 106/100; 174/182; 174/211; 252/509

[51] Int. Cl.[2]H01B 17/42; H01B 17/50; H01B 17/64

[58] Field of Search ..... 174/140 C, 141 C, 182, 174/189, 196, 211; 106/56, 64, 97, 99, 100; 252/502, 509

[56] References Cited

UNITED STATES PATENTS

| | | | |
|---|---|---|---|
| 3,819,851 | 6/1974 | Nigol | 174/140 C X |
| 3,836,705 | 9/1974 | Rosenblatt | 174/140 C |

FOREIGN PATENTS OR APPLICATIONS

| | | | |
|---|---|---|---|
| 586,065 | 3/1947 | United Kingdom | 174/140 C |

*Primary Examiner*—Laramie E. Askin
*Attorney, Agent, or Firm*—Ostrolenk, Faber, Gerb & Soffen

[57] ABSTRACT

A cement for mechanically and electrically joining metal hardware to an insulator shell having a semiconducting surface is made conductive by having graphite fibres and carbon black particles admixed therein.

4 Claims, 1 Drawing Figure

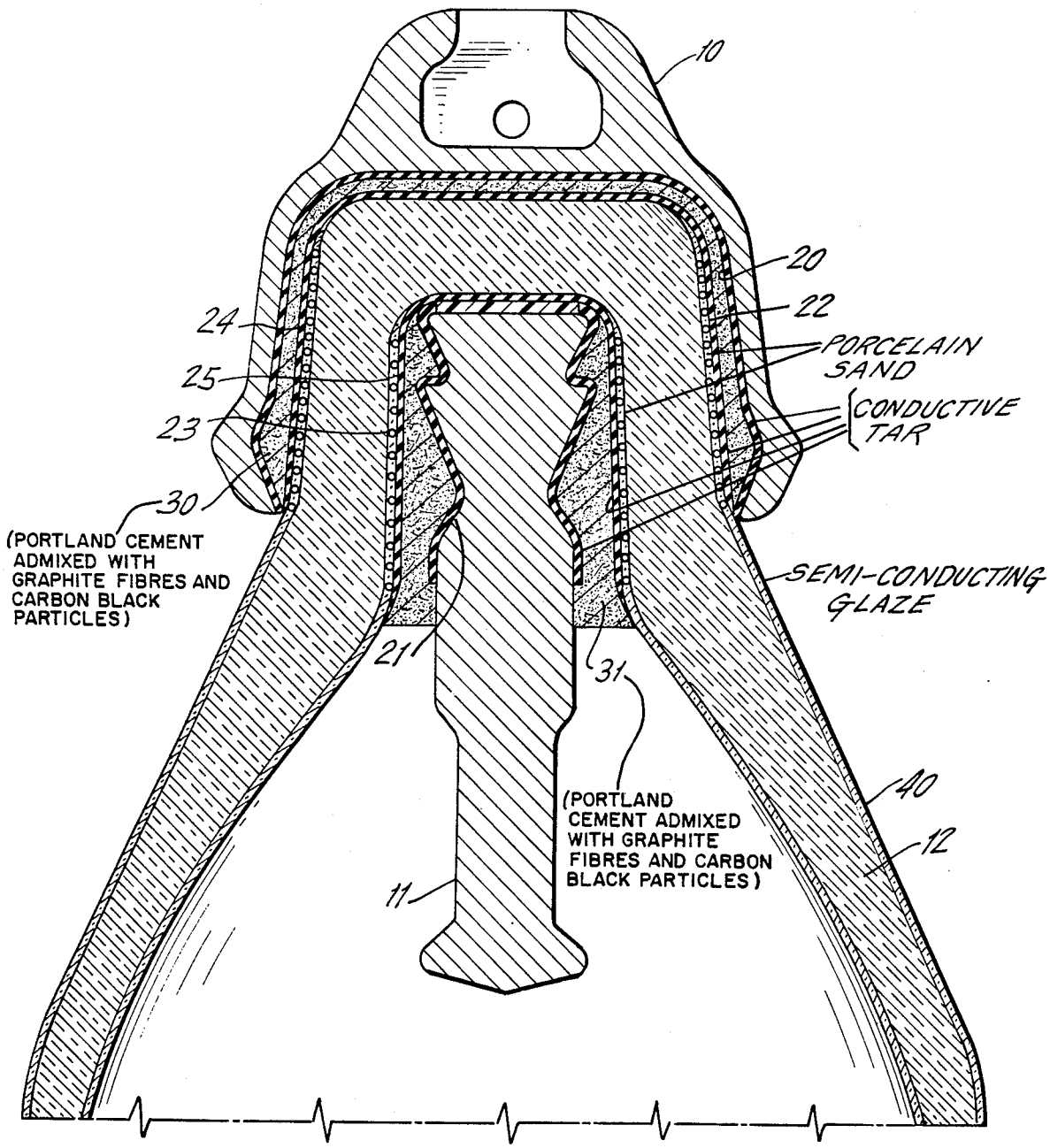
10
20
22
24
25
23
30
PORCELAIN SAND
CONDUCTIVE TAR
(PORTLAND CEMENT ADMIXED WITH GRAPHITE FIBRES AND CARBON BLACK PARTICLES)
SEMI-CONDUCTING GLAZE
21
31
(PORTLAND CEMENT ADMIXED WITH GRAPHITE FIBRES AND CARBON BLACK PARTICLES)
40
12
11

ELECTRICAL INSULATOR INCLUDING AN INSULATION SHELL HAVING HARDWARE MEMBERS SECURED THERETO BY CEMENT CONTAINING GRAPHITE FIBERS

RELATED APPLICATION

This application is related to application Serial No. 315,119, filed Dec. 14, 1972, now U.S. Pat. No. 3,836,705, entitled ELECTRICAL INSULATOR AND CONDUCTING TAR THEREFOR.

BACKGROUND OF THE INVENTION

This invention relates to electrical insulators, and more specifically relates to a novel conductive cement connecting hardware to an insulator shell where the shell has a semiconducting surface which is to be electrically connected to the hardware.

Electrical insulators, such as suspension insulators, which may be used individually or in strings to support electrical conductors from a support structure, generally consist of two conductive hardware members fastened by a cement to opposite surfaces of a suitably contoured insulator shell. The adjacent metal and insulator surfaces may be coated with a tar layer which preferably will be conductive when using the cement of the invention. A semiconducting glaze can be applied to the insulator shell surface to improve its performance especially in adverse environments. When the semiconducting glaze is used, the necessary electrical connection between the metal hardware and the semiconductive glaze is presently provided by a layer of metal which is sprayed over the normally nonconductive cement and tar layers.

BRIEF SUMMARY OF THE INVENTION

A novel conductive cement is formed in accordance with the invention, and is used with or without a conductive tar to provide a path for current flow from one conductive hardware member to the other through the semiconducting glaze. The conductive cement of the invention broadly contemplates the use of graphite fibres to form a conducting network within a cement base, such as a Portland cement, providing an electrically conductive cement with a high compressive strength. In a preferred embodiment of the invention, a quantity of carbon black is also mixed into the cement.

Therefore, a primary object of this invention is to provide a novel conductive cement used with electrical insulators having a semiconducting glaze to enable the electrical connection of the glaze to the insulator hardware through the cement.

A further object of this invention is to provide an electrical insulator including a novel conductive cement which has adequate mechanical strength.

Another object of this invention is to provide an electrical insulator including a novel conductive cement which has low shrinkage so that stable bonds can be maintained between metal and insulator surfaces.

A further object of this invention is to provide an electrical insulator including a novel conductive cement which has a consistency allowing its application to surfaces in thin cross-section layers and enabling easy removal of entrained air.

BRIEF DESCRIPTION OF THE DRAWING

The drawing is a cross-sectional view of a suspension type insulator including the conductive cement of the invention.

DETAILED DESCRIPTION OF THE INVENTION

Referring now to the drawing, there is shown a suspension insulator which has conductive hardware including an upper metal cap 10 and a bottom metal pin 11, where cap 10 and pin 11 are formed conventionally so that a number of insulators can be secured in a string. An insulator shell 12, conventionally of porcelain, is cemented between members 10 and 11. This is the conventional form of a suspension-type insulator. It will be understood by those skilled in the art that the invention disclosed hereinafter is not limited to use with suspension insulators, but can be used in any type of insulator structure.

The interior surface of metal cap 10 is coated with a thin bituminous coating 20. In a like manner, the outer surface of metal pin 11 is coated with a thin bituminous coating 21. The outer cyclindrical surface 22, and inner cylindrical surface 23 of insulation shell 12, are formed by porcelain sand layers, and these layers are in turn coated with thin bituminous coatings 24 and 25 respectively. The bituminous coatings 20, 21, 24 and 25 are strongly adherent to their respective surfaces.

The cap 10 is then secured to shell 12 by cement layer 30 while pin 11 is secured to shell 12 by cement layer 31.

The above structure is conventional, and the coatings 20, 21, 24 and 25 and cement layers 30 and 31 have insulation characteristics. As previously stated, it is known that shell 12 can have a semiconducting glaze 40 over its outer surface. In the past, where such a glaze is used, metal layers sprayed over the nonconductive cement layers 30 and 31 and the bituminous coatings 20, 21, 24 and 25 have been used to connect the glaze surface 40 to the cap 10 and the pin 11.

The present invention applies specifically to the conductive cement layers 30 and 31 and their formulation and method of compounding. Note that the tar layers 20, 21, 24 and 25 should also be conductive to take best advantage of the invention. Note further that the novel cement of the invention could be used without the tar layers and can be used in applications other than for electrical insulators.

The requirements of a cement suitable for use in electrical insulators with a semiconducting glaze are:

1. Adequate electrical conductivity which provides adequate electrical contact between the semiconducting glaze and the metal hardware. The mechanical bond between the cement and the substrate which may be either a conductive bituminous coating or a semiconducting glaze should be such that high contact resistances are avoided.

2. The cement should have high compressive strengths so that the insulator, which may be the semiconducting glazed suspension insulator of the drawing, will have the proper mechanical strength.

3. The cement should have low shrinkage with respect to time, so that the mechanical bonds between the cement and the ceramic and/or metal surfaces are not altered during service.

4. The cement should have the proper consistency so that the flow of the cement is restricted during placement of the metal hardware and not too thick to prevent the removal of entrained air.

In order to provide the last three properties of high compressive strength, low shrinkage and proper consistency, a low water-to-cement ratio is normally used with these cements. The usual practice, without the introduction of conducting phases, such as graphite fibres or carbon black, employs a water-to-cement ratio of about 0.25 to 0.28. In the cement of the invention, however, the introduction of the conducting phases, such as graphite fibres and carbon black, necessitates a higher water-to-cement ratio. This increase in the water content is required because the carbon black adsorbs and absorbs water and thus reduces the amount of water available for the cement curing reactions. Generally, the ratio will be about 0.35 to 0.45, preferably about 0.36 to 0.40.

A conducting cement can be made using graphite fibres alone without carbon black. However, in this case, a higher fibre content must be used than in the case of a cement employing carbon black as well as graphite fibres, since low fibre contents were found to lead to thermal burnout. This thermal burnout is caused by the high current densities across an insufficiently small cross-sectional area of fibres and requires additional pathways and thus higher fibre content for the electrical current.

In general, the graphite fibres are about 0.5 to 2% by weight based on the total dry weight of the conductive cement. When used alone, the fibres are usually about 1% to 2% by weight of the cement. When used with the carbon black, the fibres are typically about 0.5 to 1% by weight, preferably about 0.75 to 1% of the cement. The carbon black will generally be about 0.5 to 3% by weight, preferably about 1 to 2% based on the total dry weight of the cement.

The use of both carbon black and graphite fibres improves the required properties of the cement. The most suitable carbon blacks for the cement are those commonly used in conductive rubber or plastics. These carbon blacks are generally of fine particle size (about 15 to 55 m$\mu$), large surface area (about 55 to 260 $m^2/g$) and possess a property known as "high structure" which is the property of the carbon black to provide conductive bridges through their chain-like structure. "High structure" carbon blacks are those which have a DBP absorption number in the range of from 100–225. The DBP (Dibutly Phthalate) absorption number as determined by ASTMD2414-70 is expressed in C.C. of DBP/100 grams of carbon black with higher structure blacks recording larger numbers. Two carbon blacks which were successfully used were:

| Trade Name | DBP Absorption (CC/100 Gm. Carbon) |
|---|---|
| Vulcan XC-72 | 200 |
| Conductex SC | 101 |

In order for current to flow within the conductive cement, electron flow must occur along the carbon black clusters so that these clusters should be either in contact or very close together. The above properties influence the number and shape of the carbon clusters and hence influence the electrical conductivity of the cement. Another important property of carbon black which influences the final electrical conductivity and also mechanical strength is the surface chemistry of the particular carbon black. If substantial quantities of oxygen, also known as volatile content, are present on the surface of the carbon black, insulating films can result which reduce the cement conductivity. Equally important in the cement of the invention, care must be taken to prevent inadequate dispersion and resultant flocculation of the carbon black during mixing with water, since this results in a high electrical resistance after drying. This was particularly evident with one of the carbon blacks tested (Raven 30) which is not a carbon black commonly used for applications requiring electrical conductivity. The carbon blacks tested and found to be suitable for conducting cement grouts should be high electrical conductivity-type carbon blacks. Two satisfactory carbon blacks, each produced by electric furnace processes and subsequently purified by other processes so that an easily water-dispersed carbon black is obtained, are listed in order of effectiveness:

| Trade Name | Particle Size (Millimicrons) | Surface Area (Meters/gram) | Manufacturer |
|---|---|---|---|
| Vulcan XC-72 | 30 | 230 | Cabot Carbon Company |
| Conductex SC | 17 | 200 | Columbian Carbon Company |

Other carbon black products made by other manufacturers can also be used to form the cement of the invention.

A graphite fibre which has been found suitable is manufactured by Union Carbide Co. and is known as WFA carbon fibres (average length 2 inches and a fibre diameter between 5 and 25 microns). This material is manufactured by graphitizing cellulosic yarns in a controlled heating schedule, as described in U.S. Pat. No. 3,107,152, entitled FIBROUS GRAPHITE, C. E. Ford et al, Oct. 15, 1963. WFA carbon fibre is reported to have a tensile strength of 40,000 pounds per square inch and a specific resistance of 5,500 micro-ohm centimeters. Other similar graphite fibres produced by other manufacturers by other processes are also suitable for the cement of this invention, either alone or in combination with carbon black in a cement base to provide a conductive cement grout with adequate compressive strength. One advantage of graphite fibres in the conductive cement in combination with carbon black is a drastic lessening in the dependence on the surface chemistry of the carbon black when the two are used together. That is, the dispersion of the carbon black becomes less critical and highly conductive cements can be routinely produced.

The process for producing the conductive cement consists of two stages:

1. The wetting out and dispersion of the carbon black in about 95 to 98% of the water required for the cement. This wetting out process depends on the condition of the carbon surface and can involve soaking periods of up to 24 hours.

2. Breakup of graphite fibre and dispersion in the dry cement base by mechanical agitation, usually 10 to 15 minutes depending on the type of mixer. The wetted carbon and water are then stirred and added to the graphite fibre loaded cement which is then mixed for 10 to 15 minutes, depending on the mixer and the degree of agitation, while the remainder of the water is added to the mixture. During the latter stages of mixing, the proper consistency is reached and the grout is ready for use. It is important that not too vigorous agitation or lengthy mixing periods be employed to prevent a falling out of the carbon caused by a flocculation of the carbon black.

The amounts of carbon black, graphite fibre and water-to-cement ratio employed directly influence the electrical conductivity and compressive strength, as well as the shrinkage and cement consistency. These properties and their variation are illustrated in the following Tables I and II:

TABLE I

| WATER TO CEMENT RATIO | % of Cement by Weight: % CARBON TYPE | % CARBON FIBRE (Union Carbide WFA Type) | Volume Resistivity (ohm-cm) of Cement 1 week at room temperature | Additional Week Dried at 230°F |
|---|---|---|---|---|
| 0.35 | None | 0.5 | 3720 | 1860 |
| 0.40 | None | 0.5 | 3990 | 1330 |
| 0.45 | None | 0.5 | 3270 | 1060 |
| 0.40 | None | 2.0 | 2550 | 430 |
| 0.40 | 0.5 V | 1.0 | 17690 | 11700 |
| 0.42 | 0.5 V | 1.0 | 5320 | 2130 |
| 0.45 | 0.5 V | 1.0 | 2610 | 670 |
| 0.35 | 1.0 V | 0.75 | 2660 | 1010 |
| 0.41 | 1.0 V | 0.75 | 720 | 400 |
| 0.45 | 1.0 V | 0.75 | 690 | 690 |
| 0.40 | 2.0 V | 0.75 | 880 | 510 |
| 0.42 | 2.0 V | 0.75 | 720 | 530 |
| 0.45 | 2.0 V | 0.75 | 740 | 450 |
| 0.51 | 8.0 R | None | $532 \times 10^3$ | $2660 \times 10^6$ |
| 0.46 | 6.0 C | None | $532 \times 10^3$ | $2390 \times 10^3$ |
| 0.45 | 2.0 C | 0.5 | 53200 | 4520 |
| 0.45 | 4.0 V | None | 5850 | 6920 |
| Dispersant used Tamol SN (Rohm & Haas Co.) 7.3% of carbon weight | | | | |
| 0.47 | 6.0 C | None | $170 \times 10^3$ | $80 \times 10^3$ |
| 0.50 | 6.0 V | None | 1060 | 1060 |
| High Early Strength Cement | | | | |
| 0.45 | 1.0 V | 0.75 | 1810 | 2130 |
| 0.42 | 1.0 V | 0.75 | 4260 | 2670 |
| 0.40 | 1.0 V | 0.75 | 12770 | 10640 |

Tamol SN is a neutral salt of a condensed arylsulfonic acid (soluble in water) and is used as a carbon dispersant.

Table I above shows cement resistances for cements having different water-to-cement ratios, and different types and amounts of carbon black and carbon fibre. The cement used for the samples of Table I was a normal Portland cement. The carbon black types used are identified as follows:

V — Vulcan XC-72 (Cabot Carbon)

C — Conductex SC (Columbian Carbon)

R — Raven 30 (Columbian Carbon)

The following Table II shows the compressive strength of various cements having different water-to-cement ratios, different cement types, differing amounts of carbon fibre, and differing amounts and types of carbon black.

TABLE II

| WATER/ CEMENT RATIO | TYPE OF CEMENT | % of Cement by Weight: % CARBON & TYPE | % CARBON FIBRE | COMPRESSIVE STRENGTH, psi | CEMENT CURING CONDITIONS |
|---|---|---|---|---|---|
| 0.35 | NP | None | None | 7,350 | 7 days in water |
| 0.30 | NP | None | None | 11,500 | 7 days in water |
| 0.40 | NP | None | 2.0 | 6,735 | 7 days in water |
| 0.38 | NP | 1.0% V | 0.75 | 9,860 | 7 days in water |
| 0.38 | NP | 1.0% V | 0.75 | 8,425 | 6 days in water |
| 0.45 | NP | 2.0% C | 0.5 | 5,520 | 7 days in water |
| 0.40 | NP | 2.0% C | 0.5 | 8,615 | 14 days in water |
| 0.45 | NP | 4.0% V | None | 5,060 | 7 days in water |
| 0.46 | NP | 6.0% C | None | 5,230 | 7 days in water |
| 0.51 | HE | 8.0% R | None | 5,900 | 7 days in water |
| Dispersant - Tamol SN | | | | | |
| 0.47 | NP | 6.0% C | None | 4,855 (Brittle fracture) | 7 days in water |
| | | 6.0% V | None | 4,200 (Brittle fracture) | 7 days in water |

In Table II, the carbon fibre used was ¼ inch WFA supplied by Union Carbide Co., Ltd. The cement types used were:

NP — Normal Portland

HE — High Early Strength Portland

The tests were made on cement cubes, 2 inches on a side, using conventional measuring techniques.

From the foregoing, it can be seen that acceptable cements for insulators can be prepared having acceptable resistivities, below about 15,000 ohm-cm and compressive strengths above about 5,000 psi.

Moreover, the cements have a consistency which allows easy application to surfaces, and have low shrinkage characteristics.

As mentioned previously, conductive grouts can be obtained with 0.5 to 2 weight percent carbon fibres (based on the cement weight), with a higher content being preferred to prevent burnout during service. However, higher contents of fibres leads to pasty, unmanageable grouts. One specific suitable conducting cement for use in electrical insulators can be formulated with about 0.75% graphite fibre and 1.0% Vulcan XC-72 carbon black at a water/cement (Normal Portland) ratio of 0.36 to 0.39. This formulation exhibits good electrical conductivity (about 500 ohm-centimeters in volume resistivity) and good compressive strength (9,000 to 10,000 pounds per square inch). Increased water/cement ratios lead to lower electrical resistivities (Table I) but also lead to lower compressive strengths (Table II) and higher cement shrinkage.

An important feature of the above process is the water-curing of the cements in order to avoid the drying out of the cement during the curing process which would result in decreased compressive strengths. A period of 7 days curing under water or steam curing is preferred to obtain the required compressive strength.

Although there has been described a preferred embodiment of this novel invention, many variations and modifications will now be apparent to those skilled in the art. Therefore, this invention is to be limited, not by the specific disclosure herein, but only by the appended claims.

The embodiments of the invention in which an exclusive privilege or property is claimed are defined as follows:

1. An electrical insulator comprising, in combination:

an insulator shell having a semiconducting glaze surface, first and second conductive hardware members disposed on opposite sides of said insulator shell, first and second cement layers securing said first and second hardware members to said insulator shell; said first and second cement layers being in electrical contact with said semiconducting glaze surface;

said first and second cement layers having graphite fibres admixed therein and being electrically conductive and defining a current flow path from said first hardware member, through said semiconducting glaze surface, and to said second conductive hardware member;

and a conductive tar coating disposed between said first and second cement layers and the surfaces of said insulator shell to which they adhere.

2. The electrical insulator of claim 1 wherein said graphite fibres form less than about 2.0% by weight of said cement.

3. The electrical insulator of claim 1 wherein said cement includes carbon black.

4. The electrical insulator of claim 3 wherein said carbon black is a high structure carbon black.

* * * * *